US009412498B2

(12) United States Patent
Wassmuth et al.

(10) Patent No.: US 9,412,498 B2
(45) Date of Patent: Aug. 9, 2016

(54) ELECTRIC CABLE, IN PARTICULAR A DATA TRANSMISSION CABLE, EQUIPPED WITH MULTI-LAYER STRIP-TYPE SCREENING SHEET

(75) Inventors: Andreas Wassmuth, Roth (DE); Christian Pfeiler, Nuremburg (DE)

(73) Assignee: Draka Comteq BV, Amsterdam (NL)

( * ) Notice: Subject to any disclaimer, the term of this patent is extended or adjusted under 35 U.S.C. 154(b) by 0 days.

(21) Appl. No.: 14/397,278

(22) PCT Filed: Apr. 27, 2012

(86) PCT No.: PCT/EP2012/057784

§ 371 (c)(1),
(2), (4) Date: Dec. 16, 2014

(87) PCT Pub. No.: WO2013/159824

PCT Pub. Date: Oct. 31, 2013

(65) Prior Publication Data

US 2015/0096783 A1 Apr. 9, 2015

(51) Int. Cl.

| | |
|---|---|
| ***H01B 7/00*** | (2006.01) |
| ***H01B 11/08*** | (2006.01) |
| ***H01B 3/30*** | (2006.01) |
| *H01B 11/10* | (2006.01) |

(52) U.S. Cl.

CPC ..... *H01B 11/08* (2013.01); *H01B 3/30* (2013.01); *H01B 11/1066* (2013.01); *H01B 11/1008* (2013.01)

(58) Field of Classification Search

CPC ..... H01B 3/00; H01B 5/00; H01B 7/00; H01B 9/00; H01B 11/00

USPC ..... 174/36 R, 110 R, 113 R, 120 R

See application file for complete search history.

(56) References Cited

U.S. PATENT DOCUMENTS

| | | | | |
|---|---|---|---|---|
| 6,239,379 | B1 * | 5/2001 | Cotter | G02B 6/4416 174/110 R |
| 6,624,359 | B2 | 9/2003 | Bahlmann et al. | |
| 6,800,811 | B1 * | 10/2004 | Boucino | H01B 11/06 174/113 C |
| 2006/0048961 | A1 * | 3/2006 | Pfeiler | H01B 11/1008 174/36 |
| 2007/0037419 | A1 * | 2/2007 | Sparrowhawk | H01B 11/1008 439/98 |

FOREIGN PATENT DOCUMENTS

| | | |
|---|---|---|
| EP | 0 915 486 | 5/1999 |
| EP | 1 632 957 | 3/2006 |

OTHER PUBLICATIONS

International Search Report from the priority PCT application, dated Jan. 21, 2013.

* cited by examiner

*Primary Examiner* — William H Mayo, III
(74) *Attorney, Agent, or Firm* — Boyle Fredrickson S.C.

(57) ABSTRACT

An electric cable, in particular a data transmission cable, includes at least one line, in particular several twisted-pair lines, a screening sheet for the at least one line which screening sheet includes at least one substrate layer of a plastic material and at least one screening layer of an electrically conductive material, in particular metal, which the substrate layer is lined with, wherein the screening layer being provided with spacing gaps for electrical interruption thereof in a longitudinal strip direction, with the spacing gaps extending crosswise of the longitudinal strip direction and recurring at longitudinal intervals, an external envelope of an insulating material, and a semi-conductive shielding layer arranged between the screening sheet and the external envelope.

21 Claims, 3 Drawing Sheets

ELECTRIC CABLE, IN PARTICULAR A DATA TRANSMISSION CABLE, EQUIPPED WITH MULTI-LAYER STRIP-TYPE SCREENING SHEET

CROSS-REFERENCE TO RELATED APPLICATIONS

This application claims the priority of Patent Application Serial No. PCT/EP2012/057784 filed on 27 Apr. 2012, pursuant to 35 U.S.C. 119a)-d), the content of which is incorporated herein by reference in its entirety as if fully set forth herein.

FIELD OF THE INVENTION

The invention relates to an electric cable, in particular a data transmission cable, having at least one line, in particular several intertwisted pairs of lines, so-called twisted pairs, a screening sheet for the at least one line which screening sheet includes at least one substrate layer of a plastic material and at least one screening layer of an electrically conductive material, in particular metal, which the substrate layer is lined with, wherein the screening layer being provided with spacing gaps for electrical interruption thereof in a longitudinal strip direction, with the spacing gaps extending crosswise of the longitudinal strip direction and recurring at longitudinal intervals, and an external envelope of an insulating material.

BACKGROUND OF THE INVENTION

Such an electric cable is known from EP 1 632 957 A2. This prior art document discloses a screening sheet for the at least one line which screening sheet includes at least one substrate layer of a plastic material and at least one screening layer of an electrically conductive material, in particular metal, which the substrate layer is lined with. The screening layer is provided with spacing gaps for electrical interruption thereof in a longitudinal strip direction with the spacing gaps extending crosswise of the longitudinal strip direction and recurring at longitudinal intervals. Further on the cable includes an external envelope of an insulating material.

The problems the invention deals with can be explained most obviously in conjunction with high-speed data transmission cables, which, however, does not restrict the use of the invention to this purpose.

Customary data transmission cables use several of the above twisted pairs, for example four, which are preferably screened as the category of transmission bandwidth and transmission quality rises. External screening of the twisted pairs as well as screening of the twisted pairs one in relation to the other in a cable are important in this case.

For corresponding specifications of transmission bandwidth and transmission quality to be obtained, U.S. Pat. No. 6,624,359 B2 teaches to provide the twisted pairs with a screening sheet which is comprised of a laminate of a plastic-material substrate layer lined with a screening layer of metal. This document further shows the most varying configurations of how to fold this laminated sheet so that it forms an external screening envelope placed around several twisted pairs. Fundamentally, the screening sheet is designed as a strip of material having a continuous screening layer, for example of aluminum or copper, in the longitudinal direction of the strip.

The above design of an electrically conductive screening layer that is continuous in the longitudinal direction of the cable gives rise to problems of grounding because, given varying potentials at the ends of a line, high potential compensation currents can flow through the screening. They cause malfunction and possibly even damages of equipment connected to such a data transmission cable.

This problem is solved according to the above-mentioned EP 1 632 957 A2 by the strip-type screening sheet comprising spacing gaps in the screening layer which extend somewhat crosswise of the longitudinal direction of the strip, longitudinally recurring at intervals. They serve for electrical interruption of the screening layer in the longitudinal direction of the strip. Consequently, there is no continuous electrically conductive connection in the longitudinal direction of the screening sheet, which completely precludes any flow of potential compensation currents. But although the gaps being small as compared to the rest of the screening surface of the pieces of foil that lie between the spacing gaps, there is some deterioration in the screening properties of the screening sheet which for high-frequency applications might not be acceptable.

SUMMARY OF THE INVENTION

An object of the invention is therefore to improve the shielding performance of the known electric cable especially to further suppress the so-called "alien crosstalk" between two electric cables arranged in vicinity to each other.

This object is achieved by a semi-conductive shielding layer arranged between the screening sheet and the external envelope. In the context of the invention "semi-conductive" does not mean a typical semi-conductor like silicon but refers to a material the conductivity of which is in between an insulator and an electrically conductive material, like a metal.

Due to the physical properties of the semi-conductive shielding on the one hand a shielding effect is generated as concerns the secondary high-frequent radiation, thus effectively reducing the mentioned "alien cross-talk". On the other hand in the longitudinal direction of the cable the resistance of the semi-conductive shielding is high enough to avoid the above mentioned high potential compensation currents which could flow through the screening in case this would be from a conductive metal material. Accordingly the choice of the semi-conductive material for the shielding layer is an optimal compromise concerning two rather incompatible purposes.

According to a preferred embodiment the semi-conductive shielding layer is made of a polymer material filled with suitable semi-conductive particles. A typical example for such a material is a so-called thermoplastic black polyethylene compound, a standard semi-conductive polymer material which is commercially available and readily processed on common extruders. This material is a polymer comprising carbon black particles as semi-conductive particles.

According to a further preferred embodiment the radial thickness of the semi-conductive shielding layer lies between 0.1 mm and 0.5 mm, most preferably between 0.3 mm and 0.4 mm or explicitly 0.35 mm. These dimensions are well adapted to the usual conditions in electric cables and particularly data transmission cables.

The conductivity values expressed as the so-called volume resistivity of the semi-conductive shielding layer may range between 10 Ω·cm and 1000 Ω·cm, preferably the volume resistivity is about 100 Ω·cm. An according value of the conductivity is 0.01 $\Omega \cdot m/mm^2$. Thus it is clear that as outlined above—the term "semi-conductive" material does not mean a typical semi-conductor like silicon but refers to a material the conductivity of which is in between an insulator and an electrically conductive material, like a metal.

The semi-conductive shielding layer may preferably be extruded onto the inner parts of the cable, i.e. the screening sheet surrounding the at least one line of the cable. This is an established production method easy and reliable to handle. An economic development of this extrusion step is the co-extrusion of the semi-conductive shielding layer together with the external envelope of an insulating material.

In keeping with a further preferred embodiment of the invention, the spacing gaps in the screening layer of the screening sheet recur periodically. The ratio that the spacing-gap width bears to the length of the pieces of foil between the spacing gaps preferably ranges between 1:12 and 1:300, with typical lengths of the pieces of foil being in the range of 60 to 150 mm and typical widths of the spacing gaps being in the range of 0.5 to 5 mm. In practice, the corresponding geometric values must be chosen such that no peaks of impedance or return loss, owing to the periodicity of the structure, will occur in the range of transmission frequency of the data transmission cable.

In keeping with another preferred embodiment of the invention, successive spacing gaps are arranged at a preferably small, acute angle relative to the transverse direction of the strip.

With the spacing gaps positioned in parallel at an angle to the transverse direction of the strip, the pieces of foil therebetween have the form of a parallelogram. Upon application of the screening sheet in the longitudinal direction of the axis of the cable, this embodiment allows a gap to form that rotates in the way of a helix around the axis of the cable. Upon application of the sheet by a so-called banding system or when the cable is stranded, the acute angle of the spacing gaps relative to the transverse direction of the strip can be designed for compensation by the angle of stranding, resulting in a cylindrical gap free of metal.

Upon alternating angular position, the pieces of foil between the spacing gaps will be trapezoidal. This configuration has the advantage that, with these strips of screening sheet being wound about their longitudinal axis for a tubular envelope to form, the spacing gaps run helically, which, upon interruption of the path of the current in the longitudinal direction, is accompanied with advantages in the screening behavior as opposed to the gaps that are strictly rectangular in relation of the longitudinal direction of the strip.

According to another preferred embodiment of the invention the external envelope is made of a low smoke halogen free polymer material. Basically co-polymers of PE, EVA, filled ATH or the like materials are convenient for the outer protection layer jacket).

Finally a separating foil may be inserted between the inner part of the cable, especially the screening sheet for the internal lines, and the semi-conductive shielding layer. This construction has the advantage that with the extrusion of the semi-conductive shielding layer this material cannot intrude into the gaps which are regularly present within the internal structure of the cable, i.e. between the internal lines of the cable and the screening sheet.

Further features, details and advantages of the invention will become apparent from the ensuing description of an exemplary embodiment, taken in conjunction with the drawings.

DESCRIPTION OF THE PREFERRED EMBODIMENTS

Figure 1:
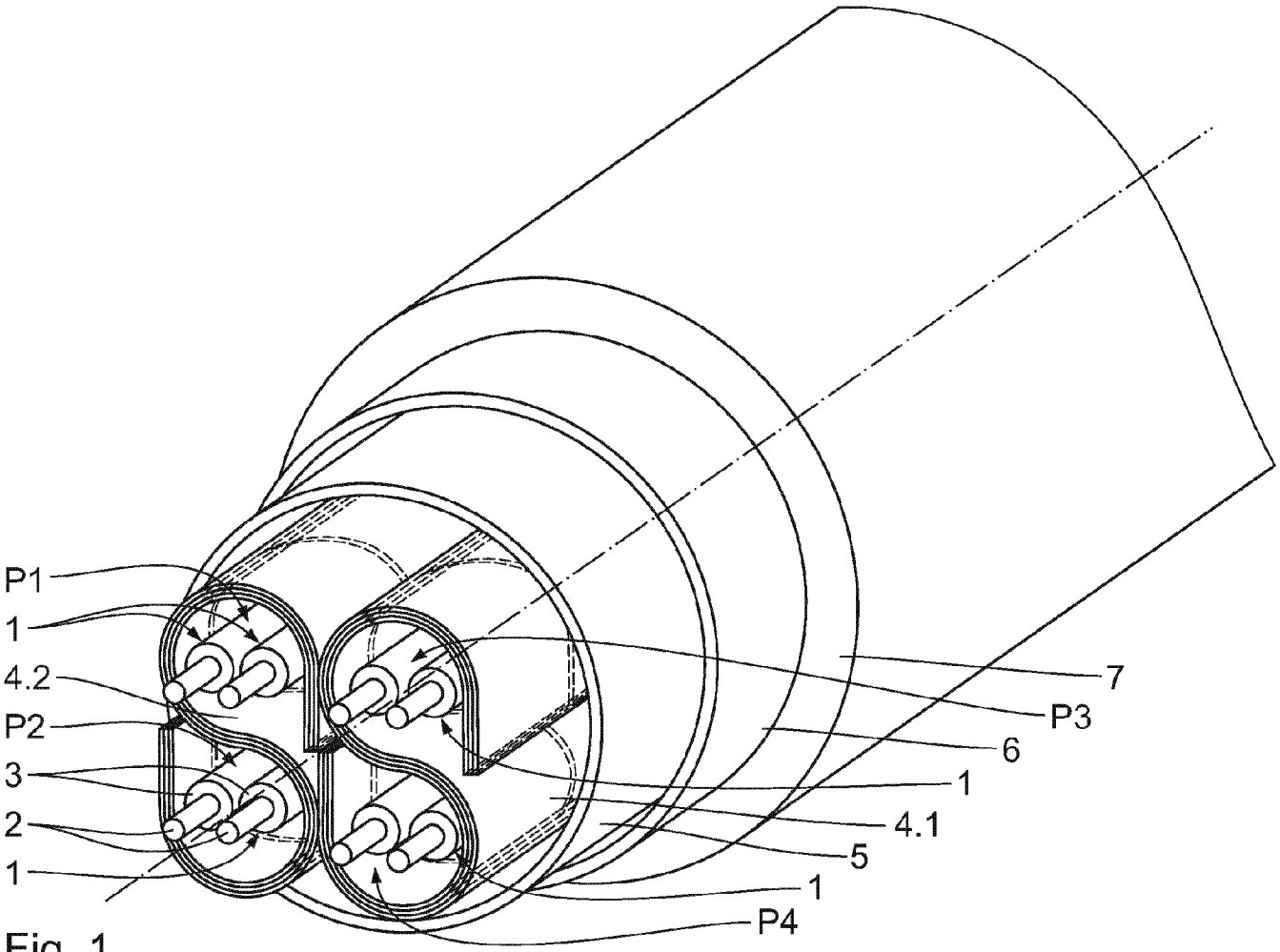
FIG. 1 is a strongly diagrammatic perspective partial view of a data transmission cable.
Figure 2:
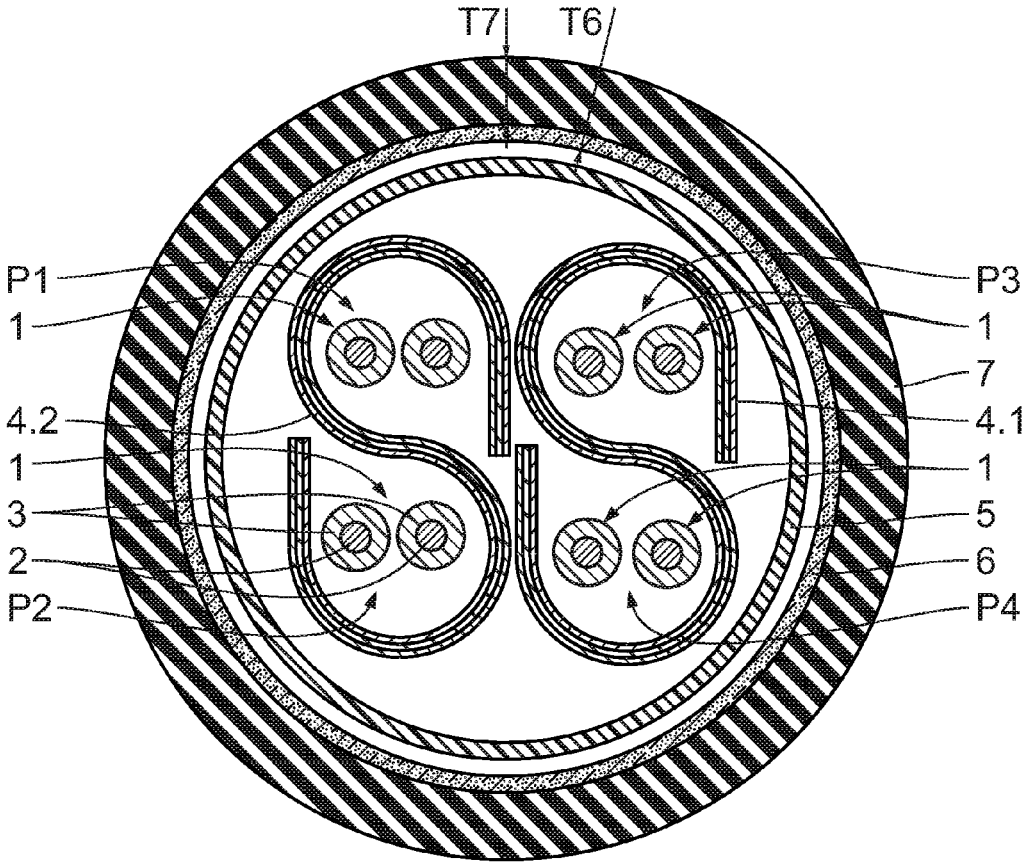
FIG. 2 is a cross sectional view of the data transmission cable of FIG. 1.

Referring to FIGS. 1 and 2 the structure of the data transmission cable can be explained. Within the core of the cable four pairs P1 to P4 of twisted lines 1 are running parallel to each other. Each line 1 has a metallic core wire 2, which is a 0.40 to 0.65 mm diameter solid or stranded bare copper wire, and a 1.0 to 1.6 mm diameter insulation 3 made of a foam skin polyolefin as is common in the art. Two pairs P1/P2 and P3/P4, respectively are surrounded by screening sheets 4.1, 4.2, which are explained in more detail in connection with FIG. 2. Both screening sheets 4.1, 4.2 are wrapped around the pairs P1/P2 and P3/P4, respectively in an S-configuration thus each pair P1 to P4 is fully surrounded by the screening sheet 4.1 or 4.2.

Further on a thin tube-like separating foil 5 made of an adequate thermoplastic material surrounds the central cables structure of the pairs P1 to P4 and the screening sheets 4.1, 4.2.

A semi-conductive shielding layer 6 is extruded onto the separating foil 5 with the pairs P1 to P4 of the lines 1 and the screening sheets 4.1, 4.2 within. The radial thickness T6 of this shielding layer 6 is about 0.35 mm, its material is a so-called carbon black polyethylene which has a volume resistivity of about 100 Ω·cm.

The outermost part of the data cable shown in FIGS. 1 and 2 is an external envelope 7 made of common low smoke halogen free polymer material according to EN 50290-2-24. Usual alternatives for the material of the envelope 7 are PE, PUR or PVC. The radial thickness T7 of the envelope 7 is about 0.3 mm, but may range from 0.2 mm to 0.8 mm.

Figure 3:
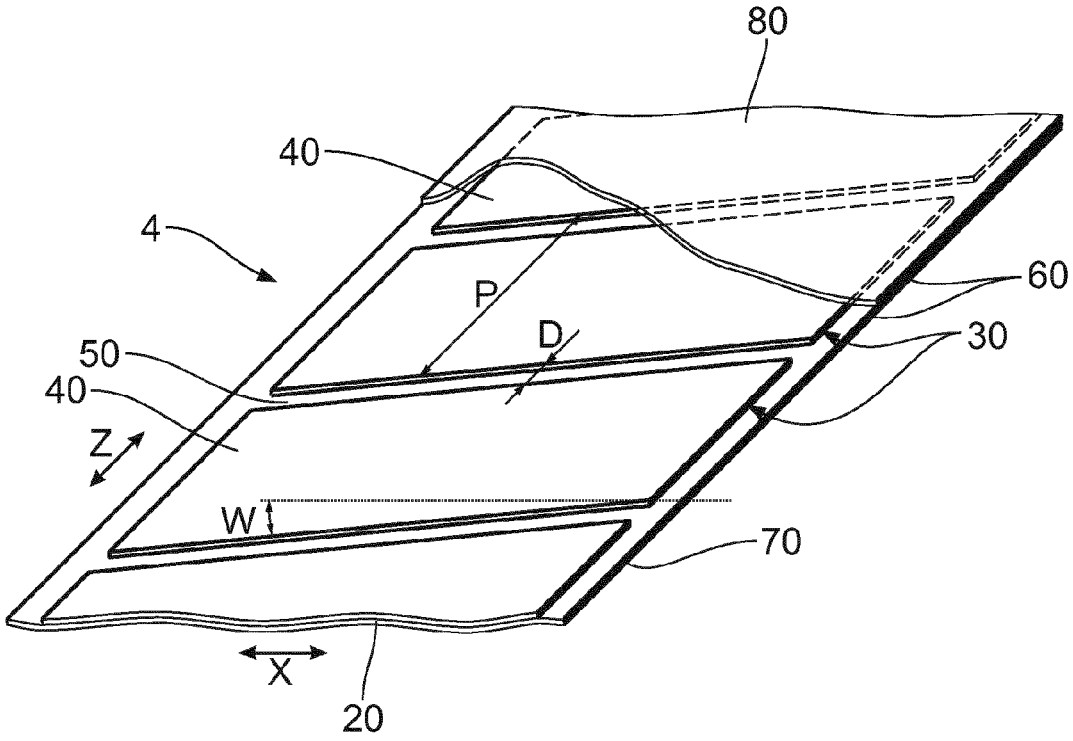
FIG. 3 is a perspective diagrammatic view, partially broken away, of a multi-layer screening sheet used within the data transmission cable of FIG. 1.

FIG. 3 illustrates the basic design of a multi-layer strip-type screening sheet 4. It comprises a first substrate layer 20 of continuous, strip-type plastic material, preferably polyester, of a thickness of 9 to 50 μm. It is lined with a screening layer 30 that consists of individual pieces of metal foil 40 separated from each other by a spacing gap 50 also indicated in dashed lines in FIG. 1). These rectangular pieces of foil have a typical length L of 60 mm to 150 mm in the longitudinal strip direction Z. The gap width D in the longitudinal strip direction Z typically amounts to approximately 0.5 mm to 5 mm so that the ratio that the gap width D bears to the length L of the pieces of foil 4 ranges between 1:12 and 1:300. The width of the pieces of foil 40 can slightly be less than that of the substrate layer 20 so that the longitudinal edges 60 of the substrate layer 20 project by some millimeters over the longitudinal edges 70 of the screening layer 30. The metal foil of the screening layer 30 preferably consists of aluminum of a layer thickness between 5 and 50 μm.

The screening layer 30 is lined with another substrate layer 80 so that a kind of sandwich sheeting is produced. The substrate layer 80 may consist of the same material as the substrate layer 20 or another suitable insulating material and is tightly united with the bottom substrate layer 20 in the vicinity of the longitudinal edges that project laterally over the screening layer 30. Thus the screening layer 30 is hermetically insulated outwards.

Durably uniting the three layers 20, 30, 80 takes place by suitable adhesives customary in the field of laminated sheeting. For reasons of manufacture and stability, the substrate layer 20 can be comprised of several layers of uniform material.

The spacing gaps 50 are disposed at a small acute angle W to the transverse direction X of the strip, but parallel to each other in this screening sheet 4.1, 4.2. Thus the pieces of metal foil 40 between two adjacent spacing gaps 50 are designed in the form of a parallelogram in a plan view.

The invention claimed is:

1. An electric cable comprising:

at least one line, screening sheet for the at least one line which screening sheet includes at least one substrate layer of a plastic material and at least one screening layer of an electrically conductive material which the substrate layer is lined with, wherein the screening layer provided with spacing gaps for electrical interruption thereof in a longitudinal strip direction, with the spacing gaps extending crosswise of the longitudinal strip direction and recurring at longitudinal intervals, and an external envelope comprised of an insulating material, and a semi-conductive shielding layer arranged between the screening sheet and the external envelope, wherein the semi-conductive layer and the external envelope are tightly bonded together.

2. An electric cable according to claim 1, wherein the semiconductive shielding layer is made of a polymer material filled with semi-conductive particles.

3. An electric cable according to claim 2, wherein the semi-conductive shielding layer is made of a thermoplastic black polyethylene compound.

4. An electric cable according to claim 2, wherein the semi-conductive particles are comprised of carbon black particles.

5. An electric cable according to claim 1, wherein the radial thickness of the semi-conductive shielding layer is between 0.1 mm and 0.5 mm.

6. An electric cable according to claim 1, wherein the volume resistivity of the material of the semi-conductive shielding layer is between 10 Ω·cm and 1000 Ω·cm.

7. An electric cable according to claim 1, wherein the semi-conductive shielding layer is extruded onto the screening sheet surrounding the at least one line.

8. An electric cable according to claim 1, wherein the semi-conductive shielding layer and the external envelope are co-extruded.

9. An electric cable according to claim 1, wherein the spacing gaps in the screening layer recur at periodical intervals.

10. An electric cable according to claim 9, wherein two successive spacing gaps extend in one of the group comprising parallel and alternating angular directions in relation to the transverse strip direction such that the pieces of the electrically conductive material that remain there-between have a shape of a parallelogram or trapezoid.

11. An electric cable according to claim 1, wherein the spacing gaps extend at an acute angle in relation to a transverse strip direction and divide the electrically conductive material into pieces thereof.

12. An electric cable according to claim 1, wherein the external envelope is made of a low smoke halogen free polymer material.

13. An electric cable according to claim 1, wherein a separating foil is inserted between the screening sheet and the semi-conductive shielding layer.

14. An electric cable according to claim 1, wherein the radial thickness of the semi-conductive shielding layer is between 0.3 mm and 0.4 mm.

15. An electric cable according to claim 1, wherein the volume resistivity of the material of the semi-conductive shielding layer is about 100 Ω·cm.

16. An electric cable according to claim 1, wherein the cable is a data transmission cable.

17. An electric cable according to claim 1, wherein the at least one line of the cable is comprised of a plurality of twisted pair lines.

18. An electric cable according to claim 1, wherein the at least one screening layer of the screening sheet for the at least one line is made of metal.

19. An electric cable according to claim 1, wherein the spacing gaps between pieces of the electrically conductive material of the screening layer having a ratio of spacing-gap width to electrically conductive material length that is between 1:12 and 1:300.

20. An electric cable according to claim 19, wherein the pieces of the electrically conductive material have a length of between 60 millimeters and 150 millimeters, and wherein the spacing gaps between the pieces of the electrically conductive material vary between 0.5 millimeter and 5 millimeters.

21. An electric cable according to claim 20, wherein the pieces of the electrically conductive material are each comprised of metal foil.

* * * * *